United States Patent [19]

Taira et al.

[11] Patent Number: 4,635,599

[45] Date of Patent: Jan. 13, 1987

[54] DISTRIBUTOR-TYPE FUEL INJECTION PUMP WITH PRELIMINARY INJECTION CONTROL DEVICE

[75] Inventors: Shigeo Taira; Toru Ishibashi, both of Higashi-Matsuyama, Japan

[73] Assignee: Diesel Kiki Co., Ltd., Tokyo, Japan

[21] Appl. No.: 744,265

[22] Filed: Jun. 13, 1985

[30] Foreign Application Priority Data

Jun. 15, 1984 [JP] Japan ..... 59-123128

[51] Int. Cl.[4] ..... F02M 59/20; F02B 3/00

[52] U.S. Cl. ..... 123/300; 123/502

[58] Field of Search ..... 123/502, 501, 299, 300; 417/462

[56] References Cited

U.S. PATENT DOCUMENTS

| | | | |
|---|---|---|---|
| 4,041,919 | 8/1977 | Bonin | 123/502 |
| 4,262,645 | 4/1981 | Kobayashi et al. | 123/502 |
| 4,351,295 | 9/1982 | Bassoli et al. | 123/300 |
| 4,501,252 | 2/1985 | Stumpp et al. | 123/502 |
| 4,508,489 | 4/1985 | Howes | 123/502 |
| 4,522,174 | 6/1985 | Babitzka et al. | 123/502 |

FOREIGN PATENT DOCUMENTS

| | | | |
|---|---|---|---|
| 3332636 | 4/1984 | Fed. Rep. of Germany | 123/502 |
| 3316458 | 11/1984 | Fed. Rep. of Germany | 123/502 |

*Primary Examiner*—Willis R. Wolfe, Jr.

*Attorney, Agent, or Firm*—Wenderoth, Lind & Ponack

[57] ABSTRACT

A distributor-type fuel injection pump for internal combustion engines includes an injection timing control device operatively connecting to a plunger and actuatable in response to the pressure within a fuel chamber in the pump housing, the plunger having a main discharge port and a preliminary discharge port for a preliminary fuel injection in advance of the next following main injection. The control device has a first member actuatable in response to the pressure within the fuel chamber for effecting a preliminary fuel injection when the pressure is at less than a predetermined value, and has a second member actuatable in response to the pressure with the fuel chamber for preventing the preliminary fuel injection when the pressure is above the predetermined value. Preferably, the predetermined pressure value corresponds to an idling speed of the engine.

9 Claims, 9 Drawing Figures

DISTRIBUTOR-TYPE FUEL INJECTION PUMP WITH PRELIMINARY INJECTION CONTROL DEVICE

BACKGROUND OF THE INVENTION

1. Field of the Invention

The present invention relates generally to a distributor-type fuel injection pump for use with an internal combustion engine such as a diesel engine for automobiles, and more particularly to such a fuel injection pump so constructed as to perform the preliminary fuel injection in advance of the main injection.

2. Prior Art

Preliminary fuel injection has been put into practice to keep the inside atmosphere in the engine cylinder in a more ignitable condition before the next following main fuel injection, thereby lightening a sudden and violent combustion upon the main fuel injection, which would otherewise cause an excessive combustion noise. Known preliminary fuel injection systems disclosed in Japanese Patent Laid-open Publication Nos. 56-56982 and 57-173552 comprise a plunger having defined therein main and preliminary fuel injection ports communicating with each other for effecting a preliminary fuel injection when the preliminary fuel injection port is brought into alignment with a distribution passage in advance of the main fuel injection port. However, such preliminary fuel injection is always effected in disregard of the engine speed (revolutions per minute) with the result that the amount of fuel to be delivered from the main fuel injection port decreases, thus causing a reduction in engine power.

According to an apparatus shown in Japanese Patent Laid-open Publication No. 54-126820, a timer is used to control the preliminary fuel injection timing such that the preliminary fuel injection takes place within a predetermined range of engine speed in dependence on the engine r.p.m. An angle defined by and between main and preliminary fuel injection ports is properly set so as to enable the preliminary fuel injection to be effected until the fuel injection advance angle reaches a predetermined threshold value which is variable under the control of a timer. The timer performance varies with the engine performance embodying the fuel injection pump. However, as shown in FIG. 9, it is generally set to retard or maintain the advance angle Ta at the reference value 0 until the engine speed reaches a predetermined value Nc which is excessively larger than an idling speed range; thereafter the advance angle Ta increases toward its maximum value. With this arrangement, the preliminary fuel injection is effected in a relatively wide range of engine speed before the angle is advanced. Since unpleasant combustion engine noise is practically observed when the engine operates near an idling speed, the prior apparatus also causes an undesirable reduction in engine power.

SUMMARY OF THE INVENTION

It is therefore an object of the present invention to provide a distributor-type fuel injection pump including a preliminary fuel injection control device which overcomes or substantially eliminates the foregoing drawbacks associated with the prior apparatus.

Another object of the present invention is to provide a distributor-type fuel injection pump so constructed as to effect preliminary fuel injection only while the engine is running near an idling speed range, thereby substantially lightening the combustion noise without causing any reduction in engine power.

According to the present invention, the foregoing and other objects are attained by providing a distributor-type fuel injection pump for an internal combustion engine having at least one cylinder, the fuel injection pump comprising: a housing having a fuel chamber defined therein; fuel supply means for supplying fuel to the fuel chamber under pressure dependent upon engine r.p.m.; a barrel mounted within the housing and having a distribution hole communicating with the engine cylinder; a plunger mounted within the barrel for axial and rotary motion therein and defining jointly with the barrel a pump working chamber communicating with the fuel chamber, the plunger having a main discharge port communicating at one end with the pump working chamber and alignable with the distribution hole for effecting a main fuel injection, and a preliminary discharge port communicating with the pump working chamber and alignable with the distribution hole before the alignment of the main discharge port with the distribution hole, thereby effecting a preliminary fuel injection before the main injection; and means operatively connected with the plunger and actuatable in respose to pressure within the fuel chamber, for controlling fuel injection timing, the control means including a first means actuatable in response to the pressure within the fuel chamber for effecting the preliminary fuel injection when the pressure within said fuel chamber is at less than a predetermined value, and a second means, actuatable in response to the pressure within the fuel chamber, for preventing the preliminary fuel injection when the pressure within the fuel chamber is above said predetermined value.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 2:
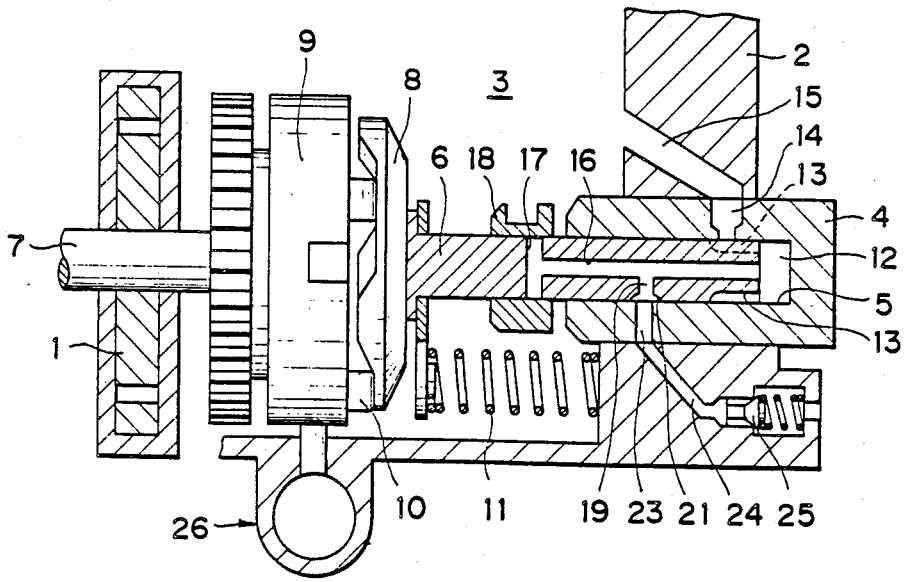
FIG. 2 is a schematic fragmentary cross-sectional view of the distributor-type fuel injection pump.

Referring now to the drawings, wherein like reference characters designate identical or corresponding parts throughout several views, and more particularly to FIG. 2, there is shown a distributor-type fuel injection pump such as the Bosch type pump which is driven by an internal combustion engine (not shown) for fuel injection.

The fuel injection pump includes an engine-driven feed pump 1 for feeding liquid fuel from a fuel tank (not shown) to a fuel chamber 3 defined in a housing 2 of the pump. The pump housing 2 has mounted therein a barrel 4 having an axial bore 5 in which a piston or plunger 6 is slidably mounted for simultaneous rotating and reciprocating motion. The plunger 6 is axially movably connected with a drive shaft 7 through a driving disc, not shown. A cam disc 8 is fixed to one or the proximal end of the plunger 6 and has a cam surface formed with projections corresponding in number to the number of cylinders of the engine. In the illustrated embodiment, the engine has four cylinders. The cam disc 8 is urged by a compression coil spring 11 into engagement with a roller carrier 9. The carrier 9 is in the form of a disc and carries rollers 10 in recesses in one surface which rollingly engage with the cam surface on the cam disc 8. Rotation of the drive shaft 7 causes the cam surface to ride up and down on the rollers 10 and thereby causes the plunger 6 to simultaneously rotate and reciprocate in the bore 5 of the barrel 4.

The distal end of the plunger 6 and the barrel 4 jointly define therebetween a pump working chamber 12. The plunger 6 has four longitudinal suction grooves 13 (two being shown) formed in the peripheral surface of the distal end of the plunger 6, the number of the grooves 13 corresponding to the number of the engine cylinders. During the suction stroke when the plunger is retracted to move leftwards in FIG. 2, one suction groove 13 faces a suction port 14 in the barrel 4 which communicates with one end of a supply passage 15 formed in the housing 2 with the other end terminating in the chamber 3, so that fuel is sucked from the chamber 3 into the pump working chamber 12.

The plunger 6 also has formed therein an axial channel 16 opening at one end to the pump working chamber 12, and a radial cut-off port 17 intersecting the other end of the axial channel 16 for communicating the channel 16 with the chamber 3. A fuel quantity setting sleeve 18 is slidably fitted over the plunger 6 and is controlled by an output from a governor (not shown) to move for closing and opening the cut-off port 17, thereby adjusting the amount of fuel injection. Fuel injection is interrupted when the sleeve 18 opens the cut-off port 17.

Figure 3:
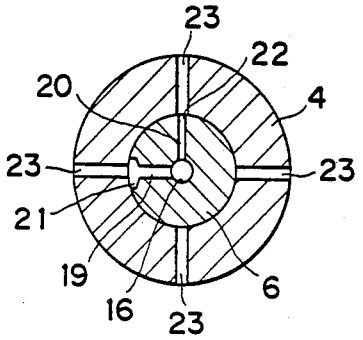
FIGS. 3 and 4 are enlarged transverse cross-sectional views illustrative of a plunger and a barrel in different positional relations.
Figure 4:
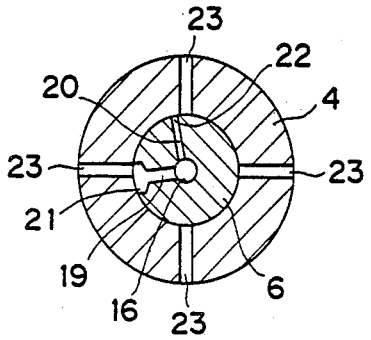

As shown in FIGS. 3 and 4, the plunger 6 further has a pair of radial passages 19, 20 communicating at one end with an intermediate portion of the axial channel 16, the passages 19, 20 being angularly spaced by the angle of 90 degrees for the engine having four cylinders. The passage 19 has at the other end thereof a main discharge port 21 while the passage 20 has at the other end thereof a preliminary discharge port 22. The barrel 4 has four radial distribution holes 23 which correspond in number to the number of the engine cylinders and are spaced at equal angular spaces of 90 degrees. The housing 2 has four outlet passages 24 communicating at one end with the distribution holes 23, respectively, the other end of each outlet passages 24 being connected with a delivery valve 25.

Now, the plunger 6 is moved rightwards in FIG. 2 through the pressure or delivery stroke, the communication between the suction grooves 13 and the suction port 14 is interrupted. Accordingly, when the main discharge port 21 is brought into alignment with one of the distribution holes 23, the fuel introduced into the working chamber 12 is delivered under pressure through the axial channel 16, the radial passage 19, the main discharge port 21, and said one distribution hole 23 into one of the outlet passages 24. The fuel then passes through a corresponding one of the delivery valves 25 into an injection nozzle (now shown) by which it is injected into one of the engine cylinders. On the other hand, as shown in FIG. 3, during the pressing stroke when the preliminary discharge port 22 faces the distribution hole 23 in advance of the main discharge port 21, preliminary fuel injection is effected in the same manner as described above with respect to the main fuel injection. This preliminary fuel injection becomes impossible when the preliminary discharge port 22 is held out of alignment with the distribution hole 23 with which the main discharge port 21 is aligned thereafter, as shown in FIG. 4. These two operation modes are controlled by a preliminary fuel injection control device or timer 26 described below.

Figure 1:
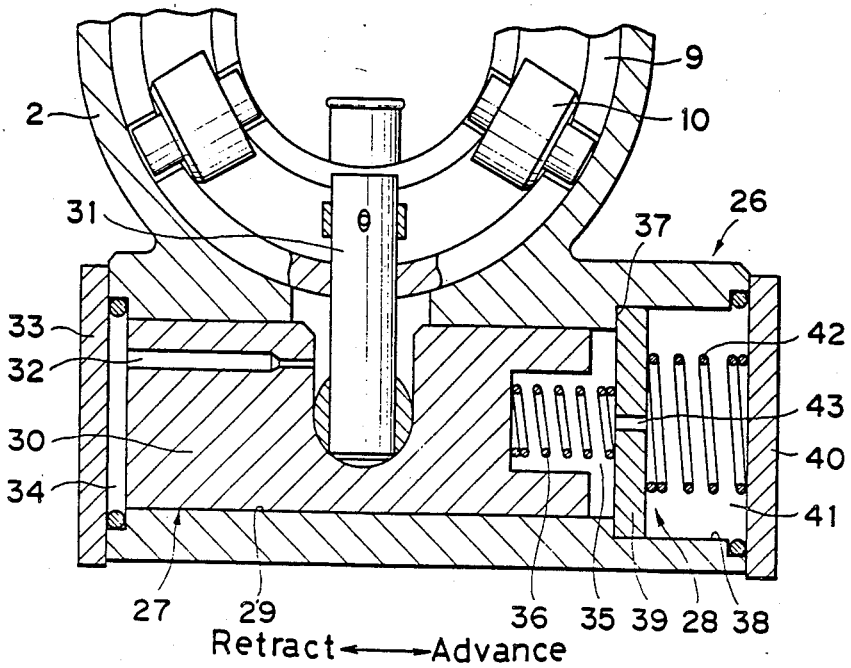
FIG. 1 is a schematic fragmentary cross-sectional view of a portion of a distributor-type fuel injection pump according to the present invention, the view showing a preliminary fuel injection control device.

The timer 26, as shown in FIG. 1, comprises a first pressure responsive means 27 and a second pressure responsive means 28 disposed in series in the housing 2. The first pressure sensitive means 27 includes a first timer piston 30 slidably disposed in a first bore 29 in the housing 2. A lever 31 is connected at one end thereof to the roller carrier 9, the other end of the lever 31 being fixed to a ball (not designated) which is rotatably received in a socket or recess (not designated) in the first timer piston 30. Rightward movement of the piston 30 causes the roller carrier 9 to rotate counterclockwise in FIG. 1 and increase the advance angle of fuel injection. The timer piston 30 is formed with an axial fuel pressure supply passage 32 opening at opposite ends thereof to the socket and one end face of the timer piston 30. A cover place 33 is secured to the housing 2 to close one end of the bore 29. Thus, a pressure chamber 34 is defined jointly between the peripheral wall of the bore 29, the timer piston 30 and the cover plate 33. The fuel chamber 3 and the pressure chamber 34 communicate with each other through the passage 32. The first timer piston 30 is urged leftwardly by a first timer spring 36 disposed in a first spring chamber 35 which is defined jointly between the peripheral surface of the bore 29, the first timer piston 30 and a second timer piston 39 (described below). With this arrangement, pressurized fluid acts on one or the left end of the first timer piston 30 against the force of the first timer spring 36.

The second pressure responsive means 28 includes the second timer piston 39 slidably disposed in a second bore 38 in the housing 2 and urged leftwardly by a second timer spring 42 into abutment with an end wall 37 of the second bore 38. The second timer spring 42 is stronger than the first timer spring 36. The diameter of the bore 38 is larger than the bore 29, the bores 29, 38 being coaxial with each other. A second cover plate 40 is secured to the housing 2 to close one end of the second bore 38. Thus, there is defined a second spring chamber 41 between the peripheral surface of the bore 38, the timer piston 42 and the cover plate 40, the second timer spring 42 being disposed in this spring chamber 41. The second spring chamber 41 communicates through a line (not shown) with the fuel tank which is non-pressurized, thereby allowing return of leaked fuel. The first and second spring chambers 35, 41 communicate with each other through an axial passage 43 in the second timer piston 39 so that the first spring chamber 35 is also non-pressurized.

Figure 7:
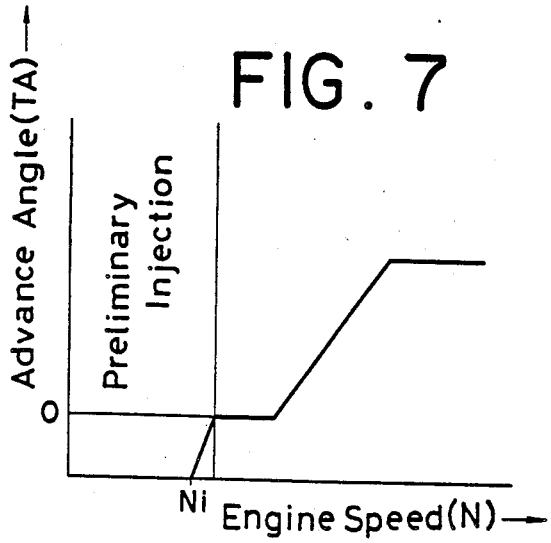
FIG. 7 is a graph illustrating the fuel injection advance property according to one embodiment of the present invention.

The operation of the preliminary fuel injection control device or timer 26 is described below with reference to FIG. 7 which shows the relation between the advance angle and the engine r.p.m. When the engine is first started, the output pressure of the pump 1 and thereby the pressure in the chamber 3, passage 32 and pressure chamber 34 is very low. Since the second timer spring 42 is stronger than the first timer spring 36, the spring 42 pushes the second timer piston leftwardly into abutment with the end wall 37 of the bore 38. The spring 36 pushes the timer piston 30 leftwardly to the position shown in FIG. 1. In this condition, the advance angle TA is retracted from the reference value 0 by a predetermined value so that during the pressure or delivery stroke the plunger 6 is located at the position of FIG. 3, thereby effecting preliminary fuel injection.

Figure 5:
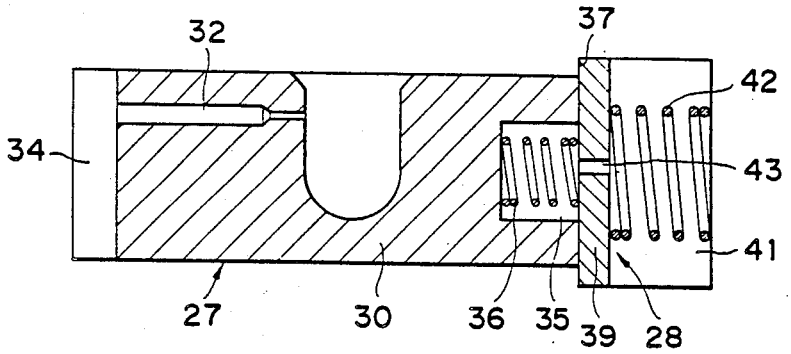
FIGS. 5 and 6 are cross-sectional views of movable members of the preliminary fuel injection control device while in different positions.

This condition is maintained until the pressure in the chamber 3 and hence the pressure in the pressure chamber 34 is sufficient to overcome the force of the spring 36. This occurs at an engine speed which is slightly larger than an engine idling speed N1. The increased pressure in the pressure chamber 34 causes the first timer piston 30 to move rightwardly in FIG. 2 against the bias of the spring 36 until it is brought into abutment with the second timer piston 39, as shown in FIG. 5. This movement of the piston 30 increases the advance angle of fuel injection. In this condition, the advance angle TA has a value which is equal to the reference value 0 with the result that during the pressure stroke the plunger 6 is brought in the position of FIG. 4 where the preliminary discharge port 22 is held out of alignment with the distribution hole 23 with which the main discharge port 21 is thereafter brought into alignment. Thus, the preliminary fuel injection is controlled to cease when the engine speed becomes slightly larger than the idling speed N1.

Figure 6:
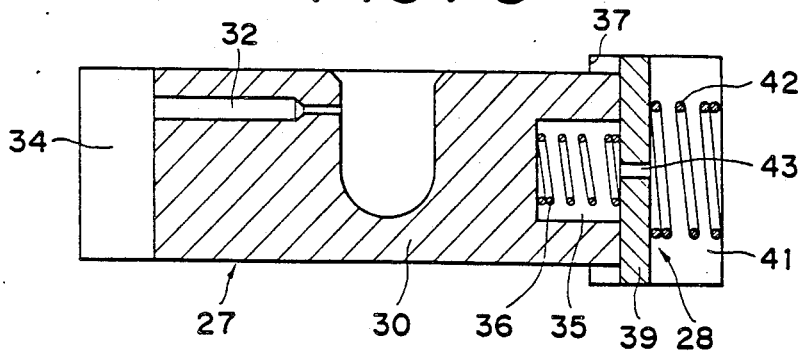

Thereafter, the first and second timer pistons 30, 39 are progressively moved rightwardly in unison against the combined force of the first and second timer springs 36, 42 to advance the angle as the engine speed increases (FIG. 6).

Figure 8:
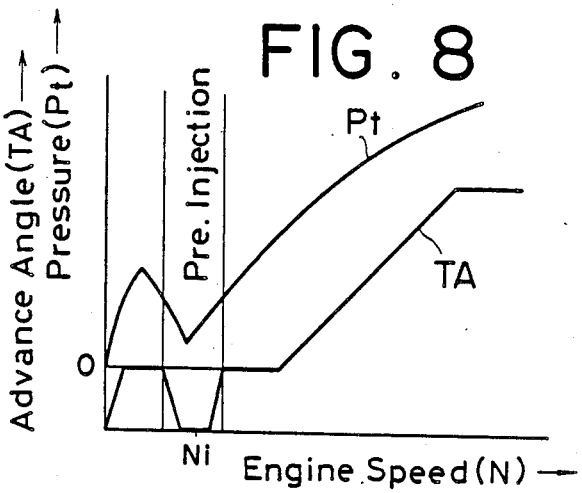
FIG. 8 is a graph illustrating the fuel injection advance property according to another embodiment of the present invention.
Figure 9:
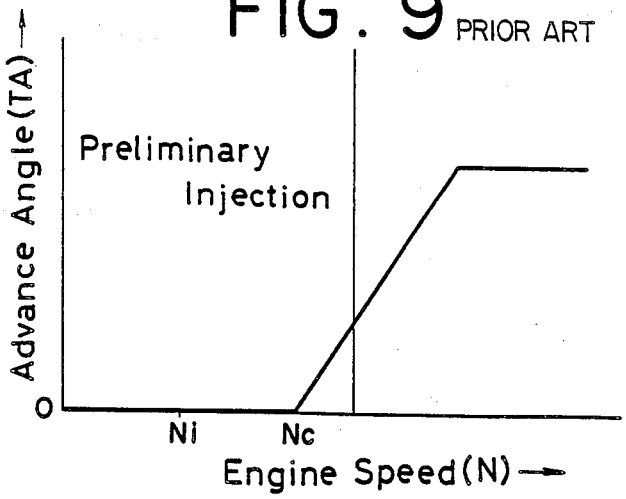
FIG. 9 PRIOR ART
FIG. 9 is a graph illustrating the fuel injection advance property according to the prior art.

In the foregoing embodiment, the advance angle has a retracted value when the engine is started. Such retracted value would affect negative influence on the engine starting properties. To improve the engine starting properties, a check valve (not shown) is provided to prevent overflow of the fuel from the fuel chamber 3 at the time of the engine starting, thereby increasing the pressure in the chamber 3 as shown in FIG. 8. With this construction, the preliminary fuel injection is carried out only in a narrower engine speed range around the idling speed than the speed range of the embodiment shown in FIGS. 1–7.

Obviously, many modifications and variations of the present invention are possible in the light of the above teachings. It is therefore to be understood that within the scope of the appended claims, the invention may be practiced otherwise than as specifically described.

What is claimed is:

1. A distributor-type fuel injection pump for an internal combustion engine having at least one cylinder, said fuel injection pump comprising:

(a) a housing having a fuel chamber defined therein;

(b) fuel supply means for supplying fuel to said fuel chamber under pressure dependent upon engine r.p.m.;

(c) a barrel mounted within said housing and having a distribution hole communicating with the engine cylinder;

(d) a plunger mounted within said barrel for axial and rotary motion therein and defining jointly with said barrel a pump working chamber communicating with said fuel chamber, said plunger having a main discharge port communicating at one end with said pump working chamber and alignable with said distribution hole for effecting a main fuel injection, and a preliminary discharge port communicating with said pump working chamber and alignable with said distribution hole before the alignment of said main discharge port with said distribution hole, thereby effecting a preliminary fuel injection before said main injection; and (e) means operatively connected with said plunger and actuatable in response to pressure within said fuel chamber, for controlling fuel injection timing, said control means including a first means, actuatable in response to the pressure within said fuel chamber, for effecting said preliminary fuel injection when the pressure within said fuel chamber is at less than a predetermined value, and a second means, actuatable in response to the pressure within said fuel chamber, for preventing said preliminary fuel injection when the pressure within said fuel chamber is above said predetermined value.

2. A distributor-type fuel injection pump according to claim 1, wherein said predetermined pressure value corresponds to an engine iding speed.

3. A distributor-type fuel injection pump according to claim 1, wherein each of said first and second pressure responsive means comprises a spring-loaded timer piston slidably disposed within said housing.

4. A distributor-type fuel injection pump according to claim 1, wherein said first and second pressure responsive means are disposed within said housing in series relation to one another.

5. A distributor-type fuel injection pump according to claim 4, wherein each of said first and second pressure responsive means comprises a spring-loaded timer piston slidably disposed within said housing.

6. A distributor-type fuel injection pump according to claim 1, wherein said housing has a first bore and a second bore communicating with said first bore at an end wall thereof, said first pressure responsive means comprising a first timer piston slidably disposed in said first bore and defining jointly with said housing a pressure chamber communicating with said fuel chamber, and a first timer spring disposed in said first bore and urging said first timer piston against the pressure within said pressure chamber, and said second pressure responsive means comprising a second timer piston slidably disposed in said second bore with a non-pressurized chamber defined between said second timer piston and said housing, and a second timer spring disposed in said non-pressurized chamber and urging said second timer piston toward abutment with said end wall.

7. A distributor-type fuel injection pump, according to claim 6, wherein said first and second timer pistons define therebetween a spring chamber in which said first timer spring is disposed.

8. A distributor-type fuel injection pump according to claim 7, wherein said second timer piston has an axial passage communicating said non-pressurized chamber and said spring chamber.

9. A distributor-type fuel injection pump according to claim 6, wherein said second timer spring is stronger than said first timer spring.

* * * * *